US006907669B1

(12) United States Patent
Han et al.

(10) Patent No.: US 6,907,669 B1
(45) Date of Patent: Jun. 21, 2005

(54) DRAWING COMPASS

(76) Inventors: Kedu Han, 4714 Mason Ct., Sugar Land, TX (US) 77479; Kehan Han, 2551 Rouen, Montreal (CA), H2K 1M7

( * ) Notice: Subject to any disclaimer, the term of this patent is extended or adjusted under 35 U.S.C. 154(b) by 0 days.

(21) Appl. No.: 10/707,951

(22) Filed: Jan. 28, 2004

(51) Int. Cl.[7] ..... B43L 9/04
(52) U.S. Cl. ..... 33/27.03
(58) Field of Search ..... 33/27.01, 27.02, 33/27.03, 27.031, 27.032, 27.033, 27.06

(56) References Cited

U.S. PATENT DOCUMENTS

| | | | | | |
|---|---|---|---|---|---|
| 487,800 | A | * | 12/1892 | Troll | 33/27.01 |
| 1,460,093 | A | * | 6/1923 | Costovici | 33/27.03 |
| 2,062,157 | A | * | 11/1936 | Benshimol | 33/27.01 |
| 2,471,193 | A | * | 5/1949 | Brower | 33/27.03 |
| 2,512,235 | A | * | 6/1950 | Lankford | 33/27.03 |
| 2,698,484 | A | * | 1/1955 | Zern et al. | 33/27.01 |
| 3,292,262 | A | * | 12/1966 | Moll | 33/27.03 |
| 3,805,391 | A | * | 4/1974 | Glasgow | 33/41.6 |
| 3,815,246 | A | * | 6/1974 | Prickett | 33/27.03 |
| 4,044,464 | A | * | 8/1977 | Schiess et al. | 30/164.9 |
| 4,616,418 | A | | 10/1986 | Wade, III | 33/27.01 |
| 4,794,699 | A | * | 1/1989 | Perna | 33/27.03 |
| 5,040,299 | A | * | 8/1991 | Hwang | 33/27.03 |
| 5,235,754 | A | * | 8/1993 | Sirois | 33/27.03 |
| 5,253,421 | A | * | 10/1993 | Landmark | 33/27.03 |
| 5,784,791 | A | * | 7/1998 | Nakamura | 33/27.03 |
| 6,311,404 | B1 | | 11/2001 | Smith | 33/27.02 |

* cited by examiner

*Primary Examiner*—R Alexander Smith
*Assistant Examiner*—V Brown

(57) ABSTRACT

A drawing compass with a structure of L shape and a method of using the same provide improved single-hand manipulation and handling of drawing an arc or circle. The drawing compass comprises a handle rotatably mounted on one end of an arm and a pivot pin holder slidably mounted along the arm. One can make an arc or circle by simply holding the handle perpendicular to a drawing surface, placing the pivot pin at the center and making a circular motion guided by the arm of the compass. In the drawing process, the pressure applied on the marking point is directly controlled by hand. The compass is easy to use, inexpensive, and simple to manufacture.

20 Claims, 4 Drawing Sheets

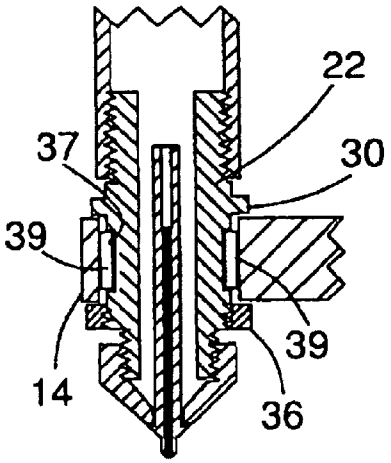
FIG. 3C
FIG. 3B
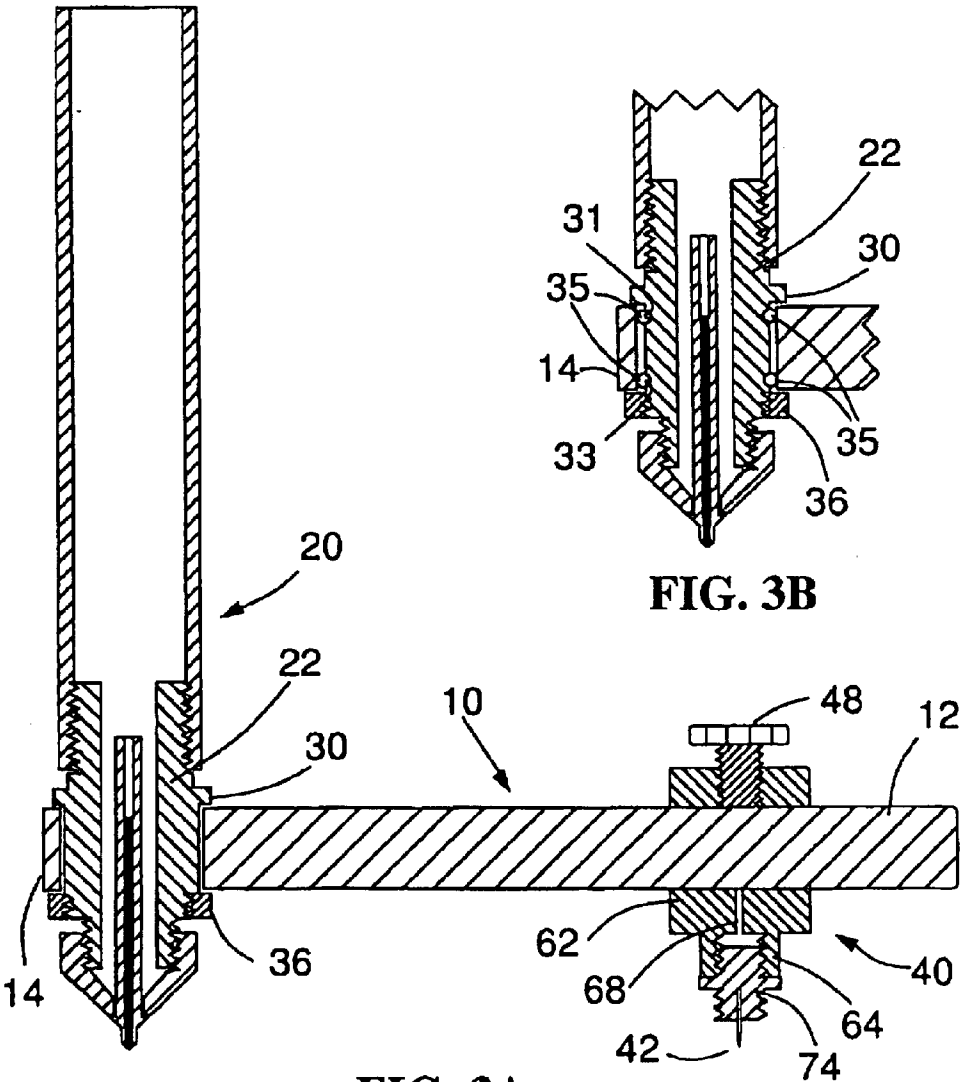
FIG. 3A

DRAWING COMPASS

BACKGROUND OF INVENTION

This invention relates to a drawing compass, and more specifically to a novel compass apparatus and the method of using the same.

Drawing compasses are well known as instruments for marking circles or arcs on draft paper or other surfaces. A traditional compass usually comprises of a handle and two legs with their upper ends pivotally attached to the handle. The free end of the first leg may be a pin or stylus.

The free end of the second leg may be a marking instrument such as a pencil, pen or chalk. The free ends of the legs can be moved open or close so that the distance between the pin and the tip of the marking instrument can be adjusted to a desired radius of a circle or arc. The compass is used by placing the pin of the first leg at the center, placing the marking tip at a start point of the circle or arc to be drawn, and twisting the handle to rotate the second leg around the first one with the marking tip scribing on the drawing surface.

Although traditional compasses have been used for many years, they have intrinsic deficiencies in usage. It requires a delicate control and balance of pressure applied on the two legs to keep one leg anchored at the center and the other rotating and scribing on the drawing surface while twisting and rotating the handle. It is difficult, as the compass is rotated by hand, to maintain the delicate pressure balance. When the pressure on marking tip becomes too light, the scribed line may be indistinct. When the pressure becomes too heavy, the friction may hinder the marking tip from scribing and even cause the pivot pin to lose anchor on the drawing surface. The manipulation requires practice and is a challenge for student, occasional users or persons with limited dexterity.

Beam compasses are also known, in which a pivot pin holder and a marking instrument holder are moveably mounted along a rigid intermediate beam. The manipulation of beam compasses requires both hands, one to hold the pivot pin in the center and the other to rotate the marking instrument around the pivotal pin. This type of compasses is generally designed for certain specific purposes and not for general usage.

There is a need for a novel type of drawing compass with easy usage and manipulation.

SUMMARY OF INVENTION

The present invention provides a novel drawing compass with features of easy usage and improved manipulation. The present invention further provides a method of using the same. And the drawing process can be easily accomplished with single hand. The drawing compass of the present invention comprises a horizontal arm, an elongated handle rotatably mounted on one end of the arm, a marking instrument attached on the lower end of the handle, and a pivot pin holder slidably mounted on the horizontal arm. Since the handle is mounted near its lower end to the horizontal arm, the structure, with the long vertically mounted handle on the left and the horizontal arm on the right, looks like a capital letter L. The unique shape and design of the present invention provide a novel and simple manipulation for drawing a circle or arc by one hand. The process of drawing a circle is as follows: hold the handle upright, place the pin point at the center and scribe a circle or arc as the circular motion is guided by the drawing compass with desired radius. While the circle or arc is been scribed, the pressure applied on the marking tip is directly controlled by hand. Such manipulation needs little practice and can be easily accomplished by students and occasional users.

In one preferred embodiment according to the present invention, a pen is integrated with the handle.

In another preferred embodiment according to the present invention, a mechanical pencil is integrated with the handle.

In another preferred embodiment according to the present invention, a pencil is utilized as a marking instrument and served as the handle.

The drawing compass of the present invention is easy to use, inexpensive, and simple to manufacture.

Additional features and advantages of the present invention are described in, and will be apparent from, detailed description of the preferred embodiments and from the illustrative drawings.

BRIEF DESCRIPTION OF DRAWINGS

FIG. 3A is a cross-sectional view taken along line 2—2 of the drawing compass illustrated in FIG. 1.

FIG. 3B is a fragmentary cross-sectional view of the drawing compass with a structure of ball bearing.

FIG. 3C is a fragmentary cross-sectional view of the drawing compass with a structure of roller bearing.

DETAILED DESCRIPTION

Figure 1:
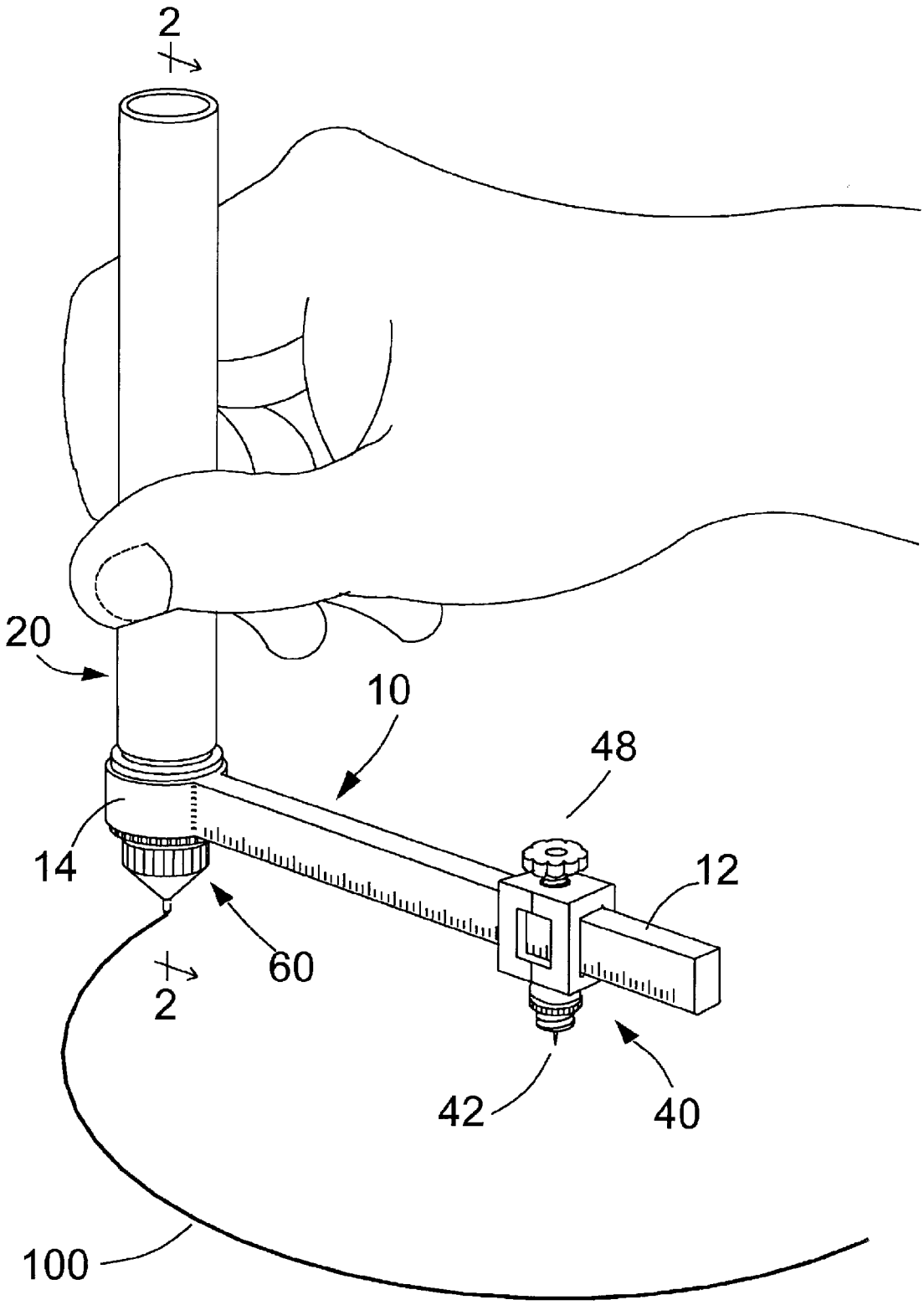
FIG. 1 illustrates the use of one preferred embodiment of a drawing compass made in accordance with the present invention.

Referring to the drawings wherein like numerals refer to like parts, FIG. 1 illustrates the use of a preferred embodiment of the drawing compass according to the present invention. The drawing compass comprises an arm 10, an elongated handle 20, a marking instrument 60 mounted on the underside of handle 20, and a pivot pin holder 40 slidably mounted on arm 10. The arm 10 comprises an elongated bar portion 12 and a cylindrical portion 14. Indicia may be placed on elongated bar portion 12 for setting desired radius, as illustrated in FIG. 1. The handle 20 is rotatably mounted on cylindrical portion 14 of arm 10. The vertical handle 20 and horizontal arm 10 form a shape of capital letter L. The pivot pin holder 40 is secured by a securing bolt 48 at a desired position on arm 10. A pointed end 42 of pivot pin holder 40 is placed at the center of a circle 100. The handle 20 is held and positioned substantially perpendicular to the drawing plane and moved along circle 100 to trace out a marking line.

Figure 2:
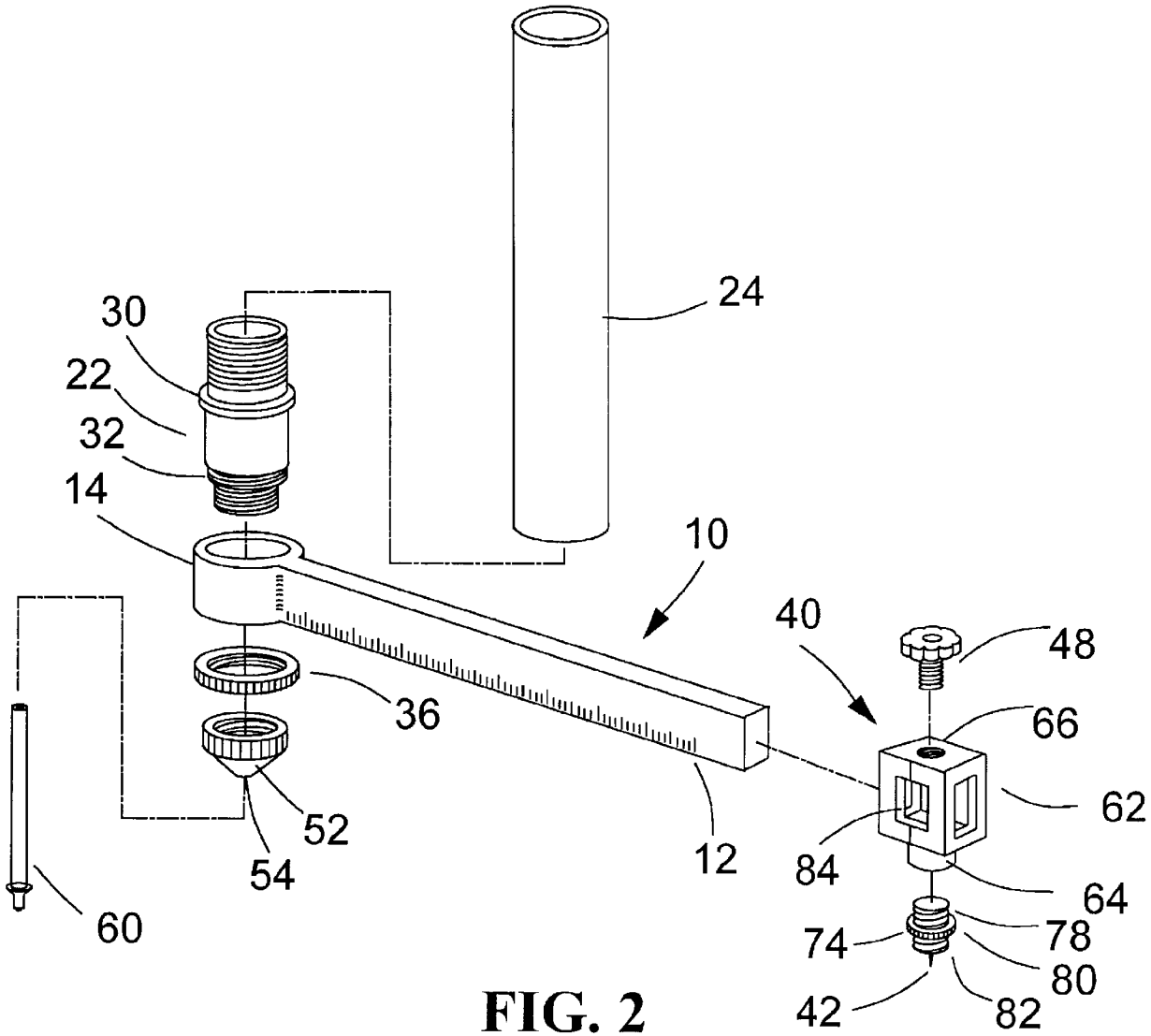
FIG. 2 is an exploded view of the drawing compass of FIG. 1, illustrating a pen attached on the lower end of the handle.

As illustrated in FIG. 2, the handle 20 comprises a cylindrical handle base 22 and an extension sleeve 24. The handle base 22 comprises an upper portion, a middle portion, and a lower portion. The upper portion of handle base 22 is externally threaded, and receives the internally threaded extension sleeve 24. The middle portion of handle base 22 receives cylindrical portion 14 which has a throughbore formed therein for rotatably coupling to the middle portion of handle base 22. The cylindrical portion 14 is retained between a collar 30 and a nut 36, which coacts in threaded engagement with a threaded portion 32 of the handle base 22. This forms a bearing structure which allows arm 10 to rotate freely while handle 20 is held during the drawing process. FIG. 3A is a cross-sectional view taken along line 2—2 of the drawing compass illustrated in FIG. 1. Alternatively, other type of bearing structures may be employed. FIG. 3B illustrates the handle rotatable mounted on the arm with a structure of ball bearing. An annular recess 31 having an arc-shad section is formed on the middle portion of handle base 22 near collar 30 and another annular recess 33 is formed on the middle portion of handle base 22 near nut 36. A plurality of balls 35 are interposed between the recesses and the opposite inner wall of cylindrical portion 14 such that arm 10 can rotate freely while handle 20 is held. FIG. 3C illustrates the handle rotatable mounted on the arm with a structure of roller bearing. An annular recess 37 is formed on the middle portion of handle base 22. A plurality of cylindrical rollers 39 are interposed between recess 37 and the opposite inner wall of cylindrical portion 14 such that arm 10 can rotate freely while handle 20 is held. The various techniques to rotatably mount the handle to the arm are well known in the art. The lower portion of handle base 22 is externally threaded for receiving a marking instrument 60 through an internally threaded marking instrument holder 52. The marking instrument such as a pen is frictionally fixed on marking instrument holder 52 through a central throughhole 54. It will be understood that the marking instrument can be easily removed from the handle base, and the marking instrument can be changed, replaced or refilled.

The pivot pin holder 40 comprises a base 62, a pivot pin 74, and securing bolt 48. The base 62 has a side opening dimensioned for slidably receiving elongated bar portion 12 of arm 10. The base 62 further comprises a threaded bore 66 perpendicular to and communicating with the side opening such that securing bolt 48 may thread through throughbore 66 to engage arm 10. The base 62 further comprises a boss 64 with an internally threaded bore for threadedly receiving pivot pin 74. Indicia on bar portion 12 can be observed from a front opening 84 of pivot base 62 for setting the radius of a circle or arc to be drawn, as illustrated in FIG. 1. The pivot pin 74 comprises a pin base and a pin extending vertically downwardly along the centerline of pivot base 62. The pin base comprises a collar 80, an upper externally threaded portion 78, and a lower externally threaded portion 82. In use, the upper threaded portion 78 is threaded on boss 64.

As illustrated in FIG. 3A, the cylindrical portion 14 of arm 10 is retained between collar 30 and nut 36 such that arm 10 is able to rotate snugly but can not move upwards or downwards along the longitudinal direction of handle 20. The pivot pin holder 40 is secured by securing bolt 48 on a fixed position of bar portion 12 of arm 10. The perpendicular distance from pointed end 42 to bar portion 12 is substantially equal to the perpendicular distance from the marking point to bar portion 12. When the drawing compass is not in use, the pivot pin 74 can be removed from boss 64 and invertly threaded on the boss 64 such that pointed end 42 is encased in an aperture 68 at the centerline of pivot base 62. It will be therefore understood that the pivot pin can be easily exchanged. It should be pointed out that, other technique of safety mechanisms may be employed to reduce the safety hazard of the pin, such as described in U.S. Pat. No. 6,311,404 to Smith.

Figure 7:
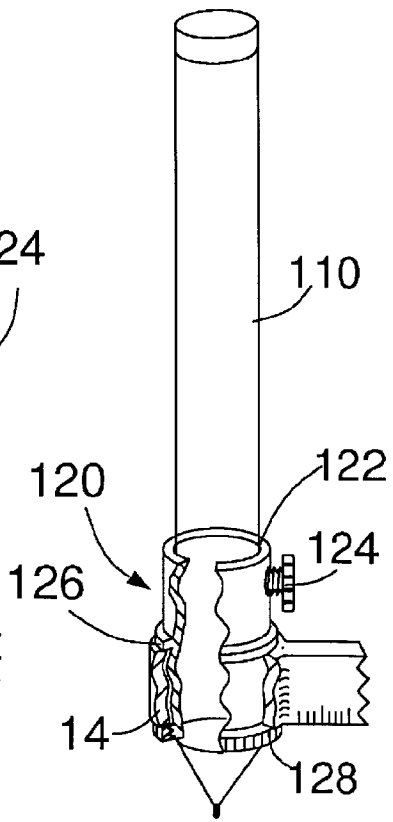
FIG. 7 is a partially sectioned side elevation view illustrated in FIG. 6, illustrating a pencil is utilized as the marking instrument and served as the handle.
Figure 6:
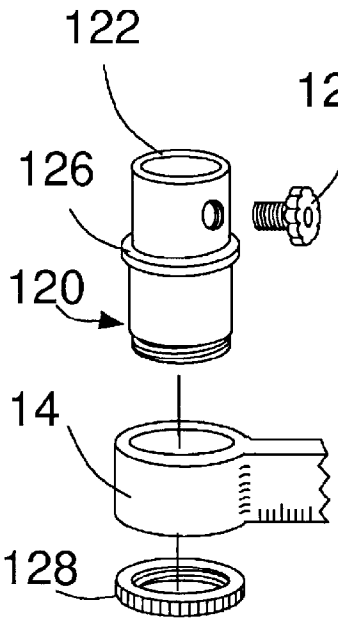
FIG. 6 is an exploded view illustrating another modified form of the handle.
Figure 5:
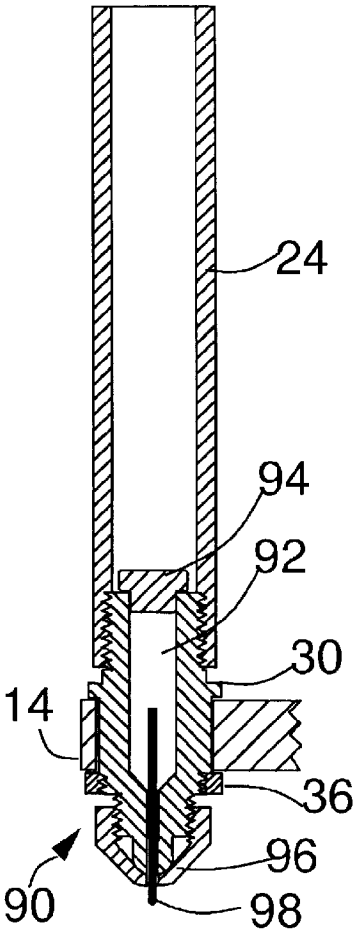
FIG. 5 is a cross-sectional view illustrated in FIG. 4, illustrating a mechanical pencil coaxially integrated with the handle.
Figure 4:
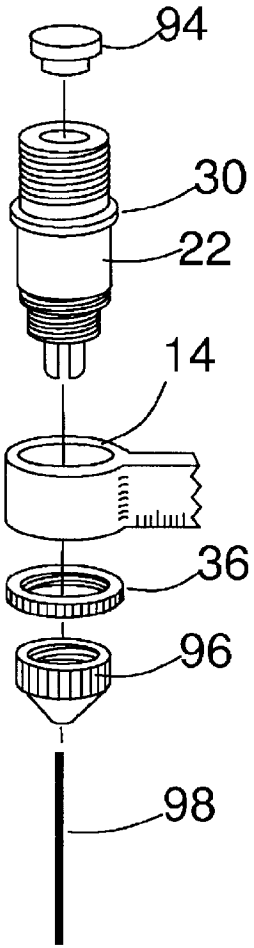
FIG. 4 is an exploded view illustrating a modified form of the handle.

FIG. 4 and FIG. 5 illustrate a modification of the handle. The device shown in FIG. 4 and FIG. 5 is different from the device shown in FIG. 2 in that a mechanical pencil 90 is coaxially integrated with the handle base. The mechanical pencil 90 comprises an interior space 92 for storing spare leads. A plug 94 plugs a bore communicating with interior space 92. The plug 94 may be an eraser or attaches to an eraser. A threaded collar 96 secures a lead 98. Any other techniques for securing leads of mechanic pencils may be employed. As illustrated in FIG. 5, the upper portion of the handle base threadedly receives extension sleeve 24. The cylindrical portion 14 is retained in the middle portion of the handle base between collar 30 and nut 36. The mechanical pencil integrated with the handle base may coaxially rotate with the handle. When the compass is not in use, the handle sleeve 24 may be removed for easy storage or transportation. FIG. 6 and FIG. 7 illustrate another modification of the handle wherein a normal pencil 110 is utilized as the marking instrument. The pencil 110 also serves as the extension sleeve. A handle base 120 comprises a cylinder 122 having an interior space defined by walls for receiving pencil 110 and securing means for retaining pencil 110 in a fixed position. The securing means comprises a securing bolt 124 threading through a female threaded bore on the cylinder for retaining the pencil 110 in a fixed position as illustrated in FIG. 7. The cylindrical portion 14 is retained between a collar 126 and a nut 128. The pencil 110 secured on handle base 120 should rotate snugly along the longitudinal axis of the handle base but should not wobble. Any other like securing means may be utilized for the purpose of securing the pencil to the handle base.

A critical aspect of the modification illustrated in FIG. 6 and FIG. 7 is the position of the marking point of the marking instrument. The marking point must be pointed at the longitudinal axis of the handle base for accuracy and reliability. The diameter of the pencil should be coupled to the interior diameter of cylinder 122 of the handle base 120. The relationship of the coaxial rotation of the pencil and the handle base should not be affected by the securing means.

As shown, the entire device can be dissembled very easily. The pencil can be changed with other marking instruments, such as a pen or a chalk.

The pin of the pivot pin holder can also be exchanged by disposable pins for ensuring center grasping force.

In use, the center point holder is adjusted to a desired radius by sliding along the elongated bar portion of the arm at a desired distance and secured to the arm by the securing bolt. The pointed end of the pin is placed at the center of the circle and the marking point of the marking instrument is placed at a start point of the circle. The handle is positioned substantially perpendicular to the drawing plane and moved along the radius of the circle as illustrated in FIG. 1. As the pressure applied on the marking point is conveniently controlled by hand a circle or arc line is easily accomplished by one hand.

When the compass is not in use, the handle sleeve may be removed from the handle base for easy storage or transportation. The pin can be removed out and reversibly threaded on the base to encase the sharp pointed end for reducing safety hazard.

It is contemplated that the drawing compass of the present invention can be made of any metals, plastics and the like materials. Material of metals is preferred because weight of the compass aids to the pin from sliding away from the center point. The size and shape of the drawing compass can be varied widely for both functional use and appearance. The length of the arm is usually 3.5–5.5 inches for general use, which may be more than 5.5 inches for use in large working plane, depending on the size of the circle to be drawn.

It should be understood that various changes and modifications to the presently preferred embodiments described herein will be apparent to those skilled in the art. Such changes and modifications may be made without departing from the spirit and scope of the present invention and without diminishing its attendant advantages. It is therefore intended that such changes and modifications be covered by the appended claims.

We claim:

1. A drawing compass, comprising:

(a) an arm having a cylindrical portion and an elongated bar portion;

(b) an elongated handle;

(c) a marking instrument attached on said handle;

(d) a pivot pin holder slidably mounted on said bar portion of said arm; and (e) means for rotatably mounting said handle on said cylindrical portion of said arm;

whereby the handle can freely rotate along the longitudinal axis;

whereby the elongated bar portion of the arm can freely rotate along the longitudinal axis of the handle.

2. The drawing compass of claim 1, wherein said handle comprises a cylindrical handle base and an extension handle sleeve; said handle sleeve comprising a threaded portion complementary coupling to a threaded portion on the upper portion of said handle base for engaging and securing said handle sleeve on the upper portion of said handle base.

3. The drawing compass of claim 2, wherein said marking instrument is mounted on the lower portion of said handle base with a marking point positioning at the axis of said handle base.

4. The drawing compass of claim 1, wherein said pivot pin holder further comprises a base, a pin having a pointed end, and a threaded securing bolt; said base comprising an opening dimensioned for slidably receiving said elongated bar portion and a threaded bore perpendicular to and communicating with said opening, said securing bolt being capable of threading through said threaded bore and engaging said elongated bar portion for retaining said pivot pin holder in a fixed position.

5. The drawing compass of claim 1, wherein said means includes bearing means.

6. The drawing compass of claim 5, wherein said bearing means comprises a collar, a threaded portion on the middle portion of the handle base, and a nut coacting in threaded engagement with the threaded portion on the middle portion of the handle base for retaining said cylindrical portion to the middle portion of said handle base.

7. The drawing compass of claim 5, wherein said bearing means is a plain bearing.

8. The drawing compass of claim 5, wherein said bearing means is a ball bearing.

9. The drawing compass of claim 5, wherein said bearing means is a roller bearing.

10. A drawing compass, comprising:

(a) an elongated arm;

(b) an elongated handle;

(c) a pivot pin holder slidably attached along said arm, said pivot pin holder having a pin with a pointed end;

(d) a marking instrument mounted on said handle; and (e) means for rotatably mounting said handle on one end of said arm;

whereby the arm can freely rotate along the longitudinal axis of the handle.

11. The drawing compass of claim 10, wherein said handle comprises a cylindrical handle base and an extension handle sleeve; said handle sleeve comprising a threaded portion complementary coupling to a threaded portion on the upper portion of said handle base for engaging and securing said handle sleeve on the upper portion of said handle base.

12. The drawing compass of claim 11, wherein said marking instrument is mounted on the lower portion of said handle base with a marking point positioning at the axis of the cylindrical handle base.

13. The drawing compass of claim 12, further including a marking instrument holder having a threaded portion complementary coupling to a threaded portion on the lower portion of said handle base, said marking instrument frictionally fixing to said marking instrument holder through a central hole on said marking instrument holder.

14. The drawing compass of claim 10, wherein said means includes bearing means.

15. The drawing compass of claim 14, wherein said means comprises a collar, a threaded portion on the middle portion of the handle base, and a nut coacting in threaded engagement with the threaded portion on the middle portion of the handle base for retaining said cylindrical portion to the middle portion of said handle base.

16. The drawing compass of claim 14, wherein said bearing means is a plain bearing.

17. The drawing compass of claim 14, wherein said bearing means is a ball bearing.

18. The drawing compass of claim 14, wherein said bearing means is a roller bearing.

19. The drawing compass of claim 10, wherein said pivot pin holder further comprises a base and a threaded securing bolt; said base comprising an opening dimensioned for slidably receiving said arm and a threaded bore perpendicular to and communicating with said opening, said threaded securing bolt being capable of threading through said threaded bore and engaging said arm for retaining said pivot pin holder in a fixed position.

20. A method for using a drawing compass, the method comprises the steps of:

providing a compass having an arm, a handle rotatably mounted on one end of the arm, a marking instrument mounted on the handle, a pivot pin holder having a pin with a pointed end and securing means securing the pivot pin holder on the arm at a desired position;

providing a marking surface;

placing the pointed end on the marking surface;

placing the marking instrument on the marking surface;

placing the handle substantially perpendicular to the marking surface;

applying pressure on the marking instrument through the handle;

moving the marking instrument in a circular motion to produce a marking line on the marking surface.

* * * * *